US006321519B1

(12) United States Patent
Goertz

(10) Patent No.: US 6,321,519 B1
(45) **Date of Patent: *Nov. 27, 2001**

(54) JIGS FOR CREATING COILED CRAFT STOCK, AND METHODS OF USING SAME

(76) Inventor: LeRoy W. Goertz, 3924 SE. 71st, Portland, OR (US) 97206-2534

( * ) Notice: Subject to any disclaimer, the term of this patent is extended or adjusted under 35 U.S.C. 154(b) by 0 days.

This patent is subject to a terminal disclaimer.

(21) Appl. No.: 09/304,620

(22) Filed: May 3, 1999

Related U.S. Application Data

(63) Continuation-in-part of application No. 08/886,872, filed on Jul. 2, 1997, now Pat. No. 5,927,059.

(51) Int. Cl.[7] ..... D02G 3/00

(52) U.S. Cl. ..... 57/3; 57/6; 57/11; 57/12; 57/18; 57/25; 57/59; 57/60; 57/64

(58) Field of Search ..... 57/3, 11, 6, 12, 57/18, 25, 59, 60, 64; 140/51, 115, 119, 122, 149

(56) References Cited

U.S. PATENT DOCUMENTS

| | | | |
|---|---|---|---|
| 827,552 | 7/1906 | McCloud | 140/51 |
| 983,911 | 2/1911 | Linn | 140/122 |
| 997,754 | 7/1911 | Clawson | 140/122 |
| 1,326,766 | 12/1919 | Moore | 140/119 |
| 1,336,649 | 4/1920 | Musson | 242/447.3 |
| 3,030,984 | 4/1962 | Vogt et al. | 140/122 |
| 4,704,855 | 11/1987 | Yoshida et al. | 57/58 |
| 4,910,954 | 3/1990 | Tizzi | 59/18 |
| 5,927,059 * | 7/1999 | Goertz | 57/3 |

OTHER PUBLICATIONS

Twist n' Curl, Wild Wire, Instruction Manual, Natural Science Industries, Ltd., 1999, 20pp.

* cited by examiner

*Primary Examiner*—John J. Calvert
*Assistant Examiner*—Shaun R Hurley
(74) *Attorney, Agent, or Firm*—Klarquist Sparkman, LLP

(57) ABSTRACT

Wire, or other material, is wrapped around a shaft as the shaft turns, producing a coil. After being slid off the end of the shaft, the coil can be re-coiled by repeating the process. By shaping the twice-coiled material, a variety of pleasing jewelry beads may be formed. A variety of jigs useful for performing process are disclosed. One jig is easily and inexpensively manufactured from a unitary length of small rod, bent to provide (a) a wrapping shaft, (b) a feature for securing a free wire end; and (c) an actuator handle. The novel principles can be implemented in many different embodiments.

11 Claims, 4 Drawing Sheets

JIGS FOR CREATING COILED CRAFT STOCK, AND METHODS OF USING SAME

RELATED APPLICATION DATA

This application is a continuation-in-part of application 08/886,872, filed Jul. 2, 1997, now U.S. Pat. No. 5,927,059.

FIELD OF THE INVENTION

The present invention relates to simple and inexpensive techniques for producing coiled materials of the sort commonly used as raw materials in craft projects.

BACKGROUND AND SUMMARY OF THE INVENTION

Coiled materials find many uses in craft projects. One example is the jewelry field, in which coiled materials (e.g. coiled wire) can be fashioned into bracelets, necklaces, earrings, beads, broaches, hair adornments, etc.

In the prior art, the most ancient technique for coiling wire is still the most common. This involves holding one wire in one hand, and physically coiling a second wire repeatedly around the first.

Another technique is to begin a coil and insert the coil into a vise with Teflon blocks. A hand crank drill then turns the wire and coils are made.

Jewelry makers sometimes make "jump rings" (the coupling rings commonly used, e.g., to join components in a necklace) by rotating a guide fixture, and guiding a wire to form a few coils therearound. The guide fixture may be turned by placing same into, e.g., a rotating chuck. This approach is not suitable, however, for producing long lengths of coil. Nor is it suitable for coiling of one flexible wire about another.

Accordingly, there is a long-felt need for a simple, inexpensive device that may be used by hobbyists to form coiled materials for use in various craft projects.

In accordance with one embodiment of the present invention, this need is met by a novel jig having a shaft for helically wrapping a wire therearound to form coiled stock. This shaft is rotatable by a crank extending away from the shaft's axis. This crank includes a crank arm rigidly coupled to the shaft for applying a torque directly thereto. The jig further includes a receptacle for receiving an end of the wire-to-be-wrapped. The receptacle and the crank arm are both arranged to rotate about the shaft's axis with actuation of the crank arm.

In one particular embodiment, such a jig is formed entirely of a unitary member bent to form the shaft, the receptacle, and the crank. The shaft can be journalled in a bracket for rotation, or can be held in one hand and rotated using the other. Such an arrangement is highly effective yet very low in cost.

The foregoing and additional features and advantages of the present invention will be more readily apparent from the detailed description, which proceeds with reference to the following drawings.

DETAILED DESCRIPTION

Figure 1:
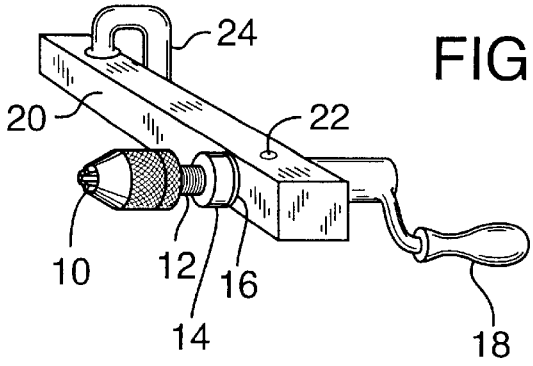
FIG. 1 is a view of a coiling jig according to a first embodiment of the present invention.

Referring to FIG. 1, a first embodiment of the present invention includes a chuck 10, a hollow tube 12, a stop collar 14 (with associated set screw - not shown), a nylon washer 16, and a crank 18. The jig is built around a main bar 20, which in the illustrated example is fashioned from a 1"×1" aluminum block.

The illustrated chuck 10 has a plurality of radially movable members 21 therein (FIGS. 1A, 1B), permitting gripping of a member inserted into the throat thereof. This chuck is of a type wherein the throat (bore) extends all the way through the chuck. Female threads on the inside of this bore permit mounting of the chuck into threads cut onto the outside of the hollow tube 12.

The bar 20 is drilled to permit passage of the hollow tube 12 therethrough and rotation of the tube therein. The tube 12 is secured in place relative to the bar by the stop collar 14 on one side, and the crank (which mounted on the outside of tube 12) on the other. An oil hole 22 permits lubrication of the tube 12 where it passes through the bar. By this arrangement, when the crank 18 is turned, the tube 12 turns and, with it, chuck 10.

The jig is secured in place by a C-clamp 24 or the like, which fastens the jig to a work surface (not shown).

As summarized above, a first ("inner") wire 17 (FIG. 5) is positioned in the throat of the chuck 10, and the radially movable chuck members are tightened thereon. The distal end of a second ("outer") wire 19 is secured to the chuck, e.g. by insertion into the small gap between two of the chuck's radially movable members 21. By this arrangement, the distal end of the outer wire turns with the chuck.

With the wires thus arranged, the chuck is then rotated. As the inner wire is rotated, the operator trains the second wire othogonally thereagainst and (slowly) laterally therealong, thereby yielding a length of coiled stock 23 (FIG. 5) with the inner wire 17 extending therethrough. After a length of coil has thus been produced, the chuck is opened and the first wire, with the second wire now coiled thereabout, is inserted into the throat of the chuck (and, therethrough, into the hollow tube 12), and the chuck is then tightened onto the coiled second wire. The operator then resumes training the second wire against the rotating first wire, extending the length of the coil earlier formed. By alternately coiling wire, and then moving and regripping the coil thus formed in the chuck (so that the coil eventually extends through the chuck and into the hollow tube 12), coiled stock of arbitrary length is quickly and simply produced. Such a coil is shown in FIG. 5.

Many crafts make direct use of the coil thus produced, without further use of the coiling jig. Some crafts, however, do make further use of the jig. An example is a coiled bead 25 of the type shown in FIG. 6C.

Figure 5:
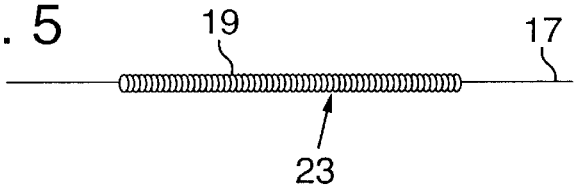
FIG. 5 is a view of coiled wire stock that can be produced by the jigs of FIGS. 1, 3, or 4.
Figure 6A:
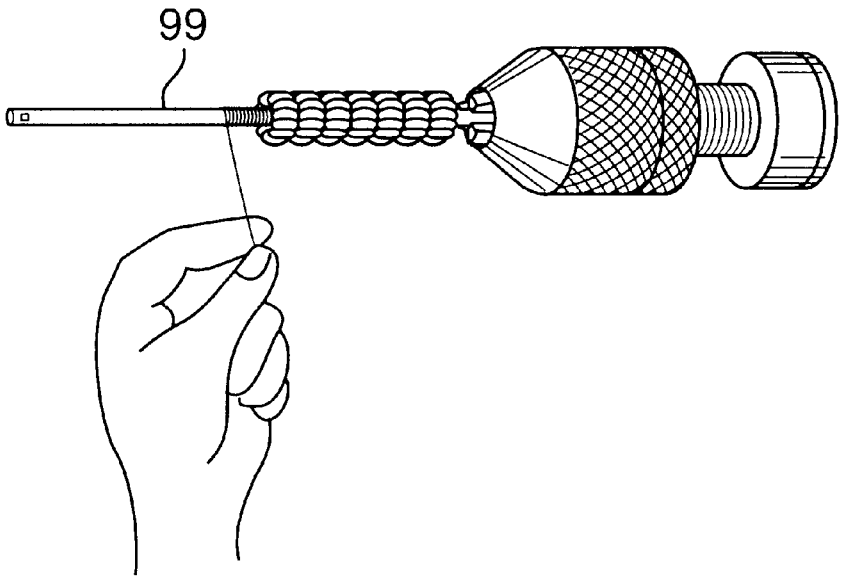
FIGS. 6A, 6B, and 6C shows steps in the formation of a coiled bead from the coiled wire stock of FIG. 5.
Figure 6B:
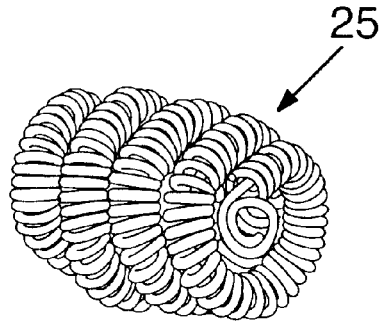
Figure 6C:
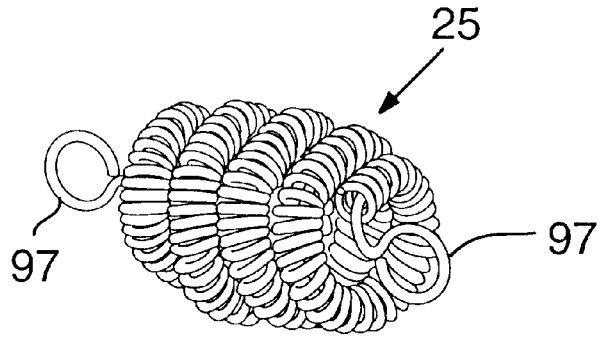

To make the coiled bead 25 of FIG. 6C, the user first produces about eight to ten inches of coiled stock, e.g. of the sort 23 illustrated in FIG. 5. This stock is then re-coiled—typically over a larger center member. FIG. 6A shows this process of recoiling over a metal rod 99. (Other larger center members, including non-cylindrical shapes, can of course be used.) The shape of the bead is then adjusted, as necessary, by pliers to result in the bead shape shown in FIG. 6B. Finally, the two ends of the center wire extending from the coiled stock are fashioned, by pliers, into coupling loops 97 (FIG. 6C).

Figure 1A:
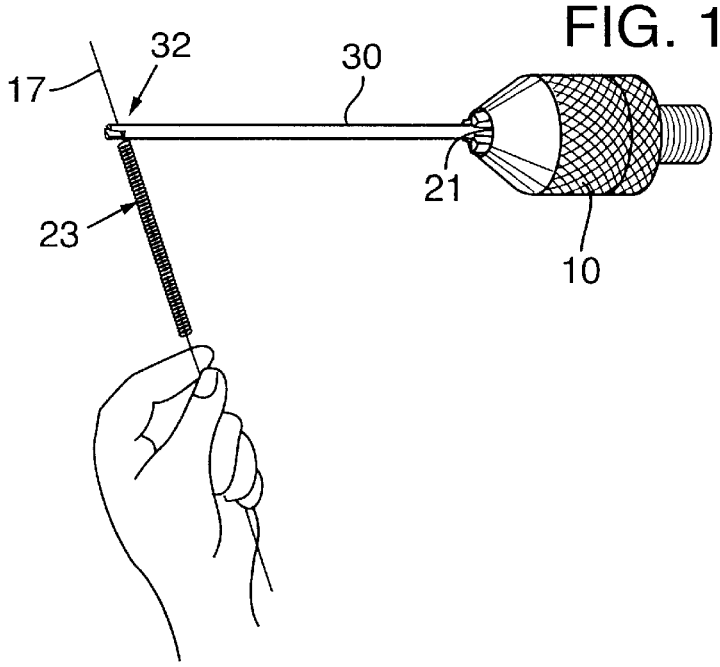
FIGS. 1A and 1B show how a once-coiled material can be engaged in the jig of FIG. 1 to effect a second, recoiling operation, e.g. to form a craft bead.

One way to effect the recoiling is shown in FIG. 1A. In this arrangement, a dowel 30 (or metal rod or the like) is secured in the jaws of the chuck 10. The exposed end 32 of the dowel has a slot cut therein. The inner wire 17 protruding from the end of the 8–10" coiled stock formed earlier is positioned in the slot. The chuck is then turned, and the coiled stock is wrapped back along the dowel, towards the chuck. After all of the stock is recoiled, it is slid off the exposed end of the dowel 30 and finished as described above.

Figure 1B:
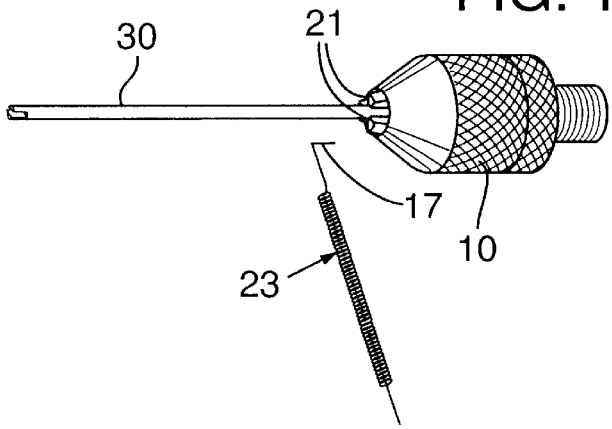

Another way to effect the recoiling is shown in FIG. 1B. In this arrangement, a dowel 30 is again secured in the jaws of the chuck. In this arrangement, however, the inner wire 17 protruding from the end of the 8–10" coiled stock 23 is inserted between the movable jaw members 21 of the chuck—off the axis of the dowel (in the same manner as the outer wire was earlier secured to the chuck when the coiled stock was first formed). Again, the operation proceeds by turning the chuck, and recoiling the stock on the dowel—this time progressing away from the chuck. After the stock is recoiled, it is slid off the exposed end of the dowel and finished as described above.

In other methods, instead of re-coiling the stock over a removable form (such as a dowel), the stock can be re-coiled over an article that is thereafter left in place to form part of the finished bead. In such an arrangement, this component article can be secured within the throat of the chuck, and the chuck (and article) rotated to permit the wrapping of the coiled stock therearound.

The selection of wire size and type depends on artistic and structural considerations. An exemplary implementation uses 20 gauge copper wire for the inner wire 17, and 22 gauge sterling silver wire for the outer wire 19. Wire sizes ranging from at least 16 to 26 gauge can be used, and others may be possible as well. Usually a larger wire is used for the inner wire, but sometimes it is desirable to use the same sized wire for both, or use a larger wire on the outside.

Figure 2:
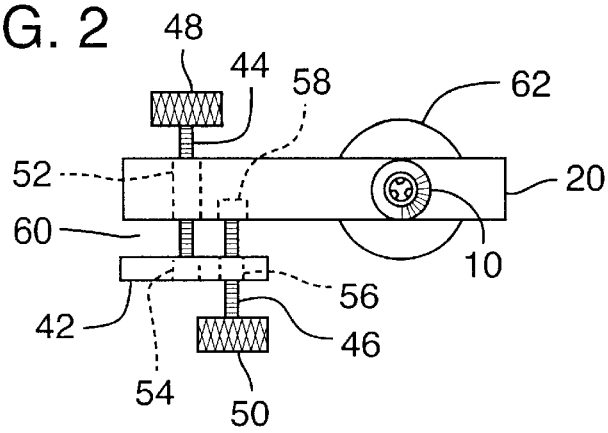
FIG. 2 is a view of a mounting clamp which may be used to secure the jig of FIG. 1 to a work surface.

While the FIG. 1 embodiment was described as employing a C-clamp to secure same to a work surface, a generally more desirable clamping arrangement is shown in FIG. 2. In this figure the apparatus includes the main bar 20 and a chuck 10, as described above. (Additionally, this figure shows a take-up spool 62, more particularly described in connection with the FIG. 3 embodiment, below.) The clamping arrangement includes a clamp bar 42, and first and second threaded bolts 44, 46—each with gripping handles 48, 50 on the head thereof.

The first bolt 44 first passes through an unthreaded bore 52 in the main bar 20, and then threads into female threads 54 that pass through the clamp bar 42. The second bolt 46 first passes through female threads 56, and thence into an unthreaded seat 58 in the main bar 20.

In use, the work surface (e.g. a table top) is positioned in the gap 60 between the main bar 20, the clamp bar 42, and the first bolt 44. The gripping handle 48 of the first bolt is then turned to bring the facing surfaces of the two bars 20, 42 into engagement with opposing surfaces of the table top. Next, the gripping handle 50 of the second bolt 46 is turned to urge the two bars apart in the vicinity of the second bolt. This has the effect of urging the two bars together on the opposite side of the first bolt 44, snugging the bars into tighter engagement with the table top. This lever action of clamping bar 42 about bolt 44 affixes the coiling apparatus more securely to a table top than can be achieved with the C-clamp approach of FIG. 1.

Figure 3:
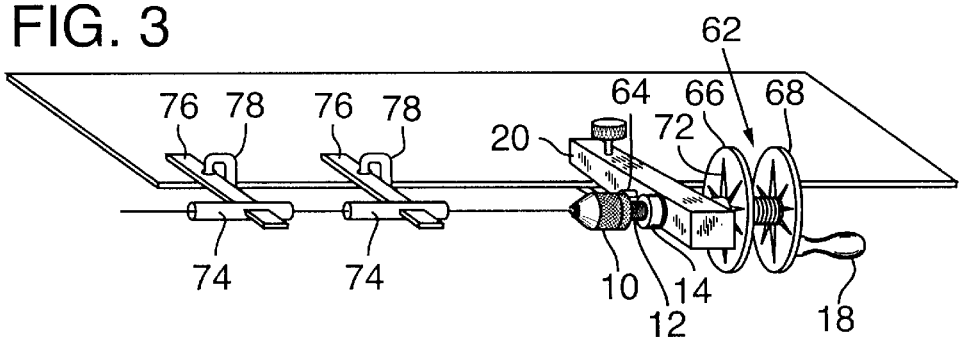
FIG. 3 is a view of a coiling jig according to a second embodiment of the present invention.

FIG. 3 shows a second embodiment of a coiling apparatus. Like the embodiment of FIG. 1, the FIG. 3 embodiment includes a chuck 10, a hollow tube 12, a stop collar 14, a nylon washer, and a crank 18, all built about a main bar 20. Additionally included in the FIG. 3 embodiment are a take-up spool 62, a brake assembly 64, and a plurality of "outriggers".

The take-up spool 62 (formed of circular metal spoked wheels 66 and 68 mounted on the outside of the hollow tube 12) is used to collect finished coiled stock that has extended 30 out of the hollow tube near the crank 18, and which would otherwise droop down and possibly torque as rotation of the hollow tube continued. After the first six inches—or so— of coiled stock is produced, the stock protruding out the crank end of the hollow tube 12 is wrapped around the spool 62 each time more coiled stock is passed through the bore of the chuck 10.

The brake assembly 64 includes a movable member that prevents undesired rotation of the chuck 10. In the illustrated embodiment, this movable member takes the form of a pin slidably mounted in a bore through main bar 20. This pin can be selectively extended through the bar and into mechanical engagement with spokes 72 of wheel 66 of the takeup spool 62. When the pin is thus extended, the disk 66, and thus the chuck 10, are prevented from rotating. Locking the chuck in this fashion greatly facilitates the loosening and tightening of the chuck jaws, operations which are performed repeatedly in the above-described method of operation. For example, with the pin extended to its "lock" position, the chuck can be both loosened and tightened with a single hand, allowing the operator's other hand to be dedicated to other tasks.

The outriggers 66 provide support of the first, central wire at locations remote from the chuck 10, facilitating use of this embodiment with long lengths of wire. Each outrigger 66 comprises a hollow shaft 74 affixed to the end of a bar 76, the opposite end of which is clamped to a work surface by, e.g., a C clamp 78.

Figure 4:
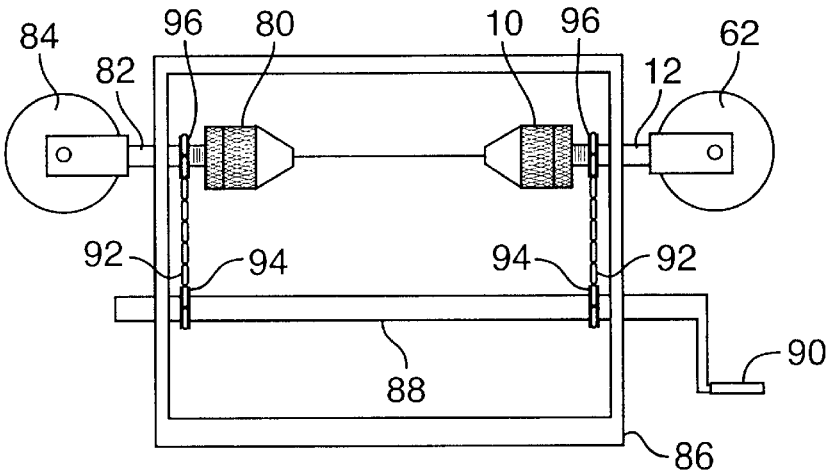
FIG. 4 is a view of a coiling jig according to a third embodiment of the present invention.

FIG. 4 shows a third, "loom" embodiment of the coiling apparatus. Like the foregoing embodiment, this embodiment includes a chuck 10, a hollow shaft 12, and a take-up spool 62. (In this embodiment, the take up spool is oriented with its axis transverse of the hollow shaft 12—an arrangement that can likewise be employed in the FIG. 3 embodiment.)

New in FIG. 4 is a second chuck 80, a second hollow tube 82, an inner wire supply reel 84, a frame 86, a drive shaft 88, a crank 90, and a pair of drive chains 92, each with associated sprockets 94, 96. Drive shaft 88 is journaled at its two ends in the frame 86. The crank 90 is mounted to an end of the drive shaft that extends slightly beyond the frame. Mounted on the drive shaft 88 are two sprockets 94, through which drive power is applied to the first and second hollow tubes 12, 82 through the chains 92 and hollow tube sprockets 96.

The first and second hollow tubes 12, 82, are also each journal led in the frame, and extend out therefrom to support the inner wire supply reel 84 and the take up spool 62, respectively.

In operation, an inner wire is first extended from reel 84, through hollow tube 82, through chuck 80, across a reach and into chuck 10. The two chucks are then tightened. A second, outer wire is secured to chuck 10 in the manner described above. Crank 90 is then turned, causing the chucks (10, 80), the hollow tubes (12, 82), and the reel/spool (84, 66) to rotate in tandem. As described above, the second wire is then trained around the inner wire, forming a coil that extends from chuck 10 towards chuck 80. This coiling operation continues until the coil extends all the way across reach to chuck 80.

Both chucks are then loosened, and the coiled stock just produced is moved to the right in the figure, through the throat of chuck 10 and into hollow tube 12. Any coiled stock extending out the right end of hollow tube 12 is wrapped around take up spool 62. The chucks are then retightened (chuck 80 is retightened on the inner wire alone; chuck 10 is tightened on newly-coiled stock), and the just-described wrapping operation is repeated.

By use of this loom embodiment, arbitrarily long lengths of coiled stock can readily be formed at a fast pace.

In all of the foregoing embodiments, the second wire is trained about the outside of the inner wire. The precise placement of this second wire during this training operation is accomplished—in the most rudimentary methods of the invention—by holding the second wire between the operator's thumb and index finger, and letting it slip therethrough as it coils about the inner wire. This manual positioning of the second wire assures that the wraps of the second wire about the first are all adjacent (assuming that this is what is desired).

Another arrangement—still relying on manual positioning of the second wire as it wraps about the first—is to employ a ring clamp. Ring clamps are well known to jewelers as simple lever-based devices for gripping a ring so that it may, e.g., be securely held against a polishing wheel. In this method, the second wire is passed through the ring clamp, and the ring clamp is positioned as desired next to the inner wire to position the second wire as it coils therearound. (The clamp is not fully tightened, so that the second wire can draw through the clamp to coil about the inner wire.)

In more sophisticated embodiments (e.g. a variant of the FIG. 4 embodiment), operator positioning of the second wire against the first can be obviated by a mechanism which automatically and continuously repositions the point along the inner wire at which the outer wire is trained thereagainst. In one such embodiment, the drive shaft 88 is threaded with a thread having the same pitch as the desired coil. A pinch clamp is then mounted on a nut that travels down the drive shaft as the shaft rotates, and the second wire is routed through the pinch clamp. As the clamp travels linearly down the threaded drive shaft, the point of application of the second wire against the first likewise progresses down the first wire, mechanically controlled by the geometry of the threads on the drive shaft.

In most embodiments, a single outer wire is coiled about a single inner wire. But this need not be the case. Interesting effects can be obtained by employing two or more wires for the "inner" wire. (Two wires will tend to lie side by side, creating coiled stock with a flat aspect. Simple fixtures can be devised to hold plural wires flat within the jaws of the rotating chuck.) Likewise it is sometimes desirable to coil two or more wires about an inner wire. A silver and a copper wire, side by side, for example, gives a pleasing visual effect. Moreover, plural outer wires need not all be coiled in the same operation. For example, a relatively large wire can first be coiled about an inner wire. Then, in a subsequent operation, a relatively smaller wire can be coiled thereon—between the wraps of the larger wire.

Having described and illustrated the features of my inventive work with reference to a variety of embodiments thereof, it should be apparent that these embodiments can be varied in arrangement and detail without departing from the general principles of my invention. For example, while I have described the fabrication of coiled stock useful in making articles of jewelry, it will be recognized that coiled materials have other craft uses as well. Stock for baskets, ornaments, and sculpture are but a few examples. Similarly, while I most commonly use wires of sterling silver and copper, it will be recognized that other types of wire, including gold, bronze, colored, etc., can alternatively be used. Likewise, while I have described the coiling of wire onto wire, it will be recognized that elongated component materials other than wire can alternatively be used. (I sometimes find it desirable to coil wire onto string, for example. If string, or another limp medium, is used as the base onto which a material is coiled, it is helpful to provide means for holding the string taut. This is readily accomplished in the third embodiment by stretching the string taught between the two chucks. In other embodiments, the string may be kept taught between a single chuck and a fixed object to which the end of the string is attached through, e.g., a swivel.)

Still further, it will be apparent to those skilled in the art that various of the mechanical components of the illustrated embodiments can be substituted with other components. The chuck, for example, may take the form of a clamp that holds the wire(s), etc., in place with a set screw arrangement. Similarly, the direct drive or chain drive systems can be replaced with ones employing gears (including worm drive arrangements). The stop collar 14/washer 16 arrangement can be replaced with an oil-impregnated bushing that is press-fit into an oversize bore formed in the main bar 20. Myriad other arrangements can, of course, be employed—each providing its own advantages, in accordance with the particular application being addressed.

Figure 7:
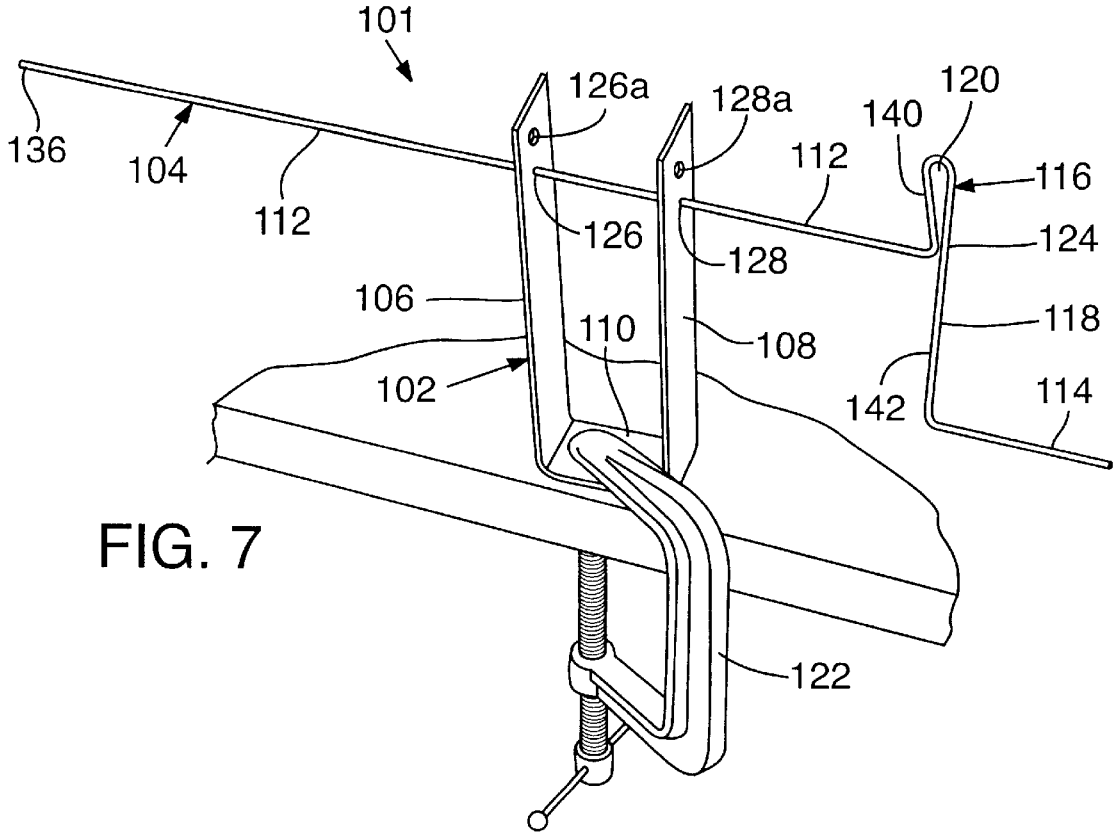
FIG. 7 is a view of a jig according to another embodiment of the present invention.

To illustrate the range of embodiments according to the present invention, consider the winder arrangement 101 shown in FIG. 7. This embodiment includes a bracket frame 102 and a jig 104. The bracket frame 102 has two vertical uprights 106, 108, connected by a base member 110. As can be seen, the frame 102 can be formed simply by bending a strip of sheet metal with two right-angle bends. The jig has a main wire wrapping shaft 112 and a handle 114 intercoupled through members 116 and 118. Member 116 forms a receptacle, or eye 120, through which wire can be passed, as detailed below. Illustrated member 118 is perpendicular to shaft 112. Handle 114 is parallel to shaft 112 but offset therefrom. The illustrated jig is formed of round metal rod stock or stiff wire (e.g., 16 gauge).

In operation, the bracket frame 102 is screwed to a base (e.g., a board) by a screw that passes through a hole in the base member 110 of the bracket. (Other known attachment means can naturally be used, including the illustrated C-clamp 122, etc.) The user then takes the end of a wire and pushes it through the eye 120 of the jig and wraps it around a neck 124 of the eye or otherwise secures same. The shaft 112 is then inserted through holes 126, 128 in the bracket uprights 106,108, journalling the shaft for rotary motion.

A right-handed user next holds the trailing portion of the wire against the shaft 112—next to the eye 120—with the thumb of the left hand, while operating the crank handle with the right hand in a circular motion to spin the shaft 112 around its own axis. As the shaft is rotated, the wire wraps around the shaft and is urged against the previous wrap(s) by the user's left thumb. Continued cranking yields a coil of wire around the shaft.

When a coil of the desired length has been formed, the user cuts or otherwise frees the end of the wire from the eye, and slides the coil off the end 136 of the shaft. Typically, the user then inserts a center wire through the axial bore of the just-removed coil to increase the structural integrity of the coil. By using a relatively small center wire, the coil is more pliable; by using a relatively large center wire, the coil is more sturdy.

While the coil so-produced is usable as—is in some applications, other applications re-coil the coil to yield, e.g., the ornamental jewelry beads discussed above. To facilitate such re-coiling, the illustrated winder 101 has a second, larger jig (e.g., made of 8 gauge wire), which passes through a second set of commensurately larger holes 126*a*, 128*a* in the bracket frame 102.

As before, the end of the coil (or the wire extending from the bore thereof) is passed through the eye 120 and secured in place. The free part of the coil (or the protruding center wire, initially) is urged against the (larger) shaft 112 by the user's left thumb as the shaft is rotated by the user's right hand. As the shaft is turned, the coil stock is wrapped there-around, yielding the re-coiled coil shown, e.g., in FIG. 6A. Again, when the re-coiling is completed, the end of the coil is freed from the eye 120, and the re-coiled coil (i.e., bead) is slid off the end of the shaft.

It will be recognized that, as the shaft 112 spins around its axis, the eye 120 and the handle 114 similarly rotate about this axis. Member 118 is rigidly coupled to the shaft 112, and includes a first portion 140 extending in one direction away from the shaft, and a second portion 142 extending in a second, opposite direction away from the shaft. The handle 114 is affixed to the outermost-end of this second portion.

Figure 8:
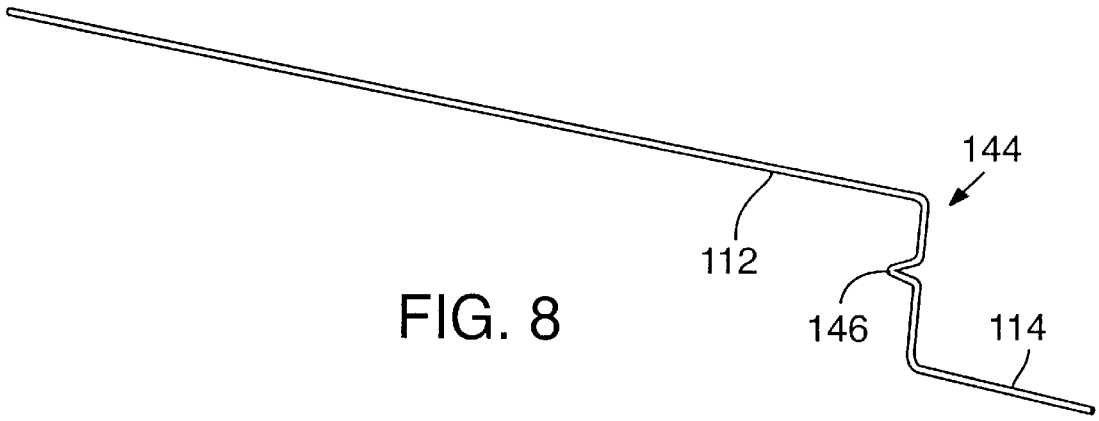
FIG. 8 shows a variant of the FIG. 7 jig.

While the illustrated eye 120 lies in the same plane as the shaft 112 (with its eye defining an opening that faces in a direction orthogonal to the axis of the shaft), it will be recognized that different arrangements can naturally be employed. For example, the same basic structure can be used, but with the eye rotated ninety degrees, so that the material defining the eye lies in a plane orthogonal to the shaft, and the eye's opening faces in a direction parallel to the shaft's axis. Many entirely different arrangements for securing the wire's free end can also be employed, as will be apparent to those skilled in the art. One such arrangement 144 is shown in FIG. 8 and includes a wire attachment dimple 146.

While the just-described operation journalled the shaft in the bracket, this need not be the case. The jig 104 can instead be held in the user's left hand, resting on the side of the user's index finger, while the left thumb presses the wire against the shaft. The right hand, again, moves the handle in a circular motion to rotate the shaft and effect the wrapping.

In view of the foregoing, it should be recognized that the arrangements described above illustrate but a few of the many forms my inventive work may take, and should not be understood as limiting the scope of my invention. Rather, I claim as my invention all such embodiments as may fall within the scope and spirit of the following claims, and equivalents thereto.

I claim:

1. A jig for creating coiled stock useful in crafts, the jig having a shaft extending along a first axis for helically wrapping a wire therearound to form coiled stock, the shaft being rotatable by a crank extending away from the first axis, the crank comprising a crank arm for applying a torque to rotate the shaft, said crank arm being rigidly coupled to the shaft to provide direct drive thereto, the crank arm extending away from the first axis, the jig further defining a receptacle for receiving an end of said wire, the receptacle and the crank arm both being arranged to rotate about the first axis with actuation of the crank arm.

2. The jig of claim 1 comprising a second member oriented perpendicular to the first axis and rigidly coupled to the shaft, said second member having portions extending in two opposite directions away from the shaft.

3. The jig of claim 1 in which the receptacle defines an opening having an axis extending parallel to said first axis, wherein the end of the wire routed through said opening is substantially parallel to the first axis.

4. The jig of claim 1 in which the crank includes a member extending substantially parallel to the first axis.

5. A method of using a jig for creating coiled stock useful in crafts, the jig having a shaft extending along a first axis for helically wrapping a wire therearound to form coiled stock, the shaft being rotatable by a handle extending away from the first axis, the jig including an arm for applying a torque to rotate the shaft, said arm being rigidly coupled to the shaft to provide direct drive thereto, the arm extending perpendicularly away from the first axis, the jig further defining a receptacle for receiving an end of said wire, the receptacle and the crank arm both being arranged to rotate about the first axis with actuation of the crank arm, the method comprising:

placing an end of the wire into the receptacle to secure the wire;

with a first hand, applying a force to the crank arm, causing an end of said crank arm to circumscribe a circle centered about the shaft, said force serving to rotate the shaft by direct drive;

with a second hand, training a free portion of the secured wire against the rotating shaft to coil the wire there-around; and removing the end of the wire from the receptacle and slipping the coiled wire off the shaft.

6. The method of claim 5 which includes journalling the shaft for rotation in a bracket.

7. The method of claim 5 which includes holding the shaft for rotation with said second hand.

8. A jig for manually creating coiled stock useful in crafts, the jig having a shaft, a wire attachment feature, and an actuator, wherein the jig is entirely formed of a unitary member bent to form the aforesaid elements.

9. The jig of claim 8 in which the member comprises round rod stock or stiff wire.

10. The jig of claim 9 in which the member:

extends along a first axis to form the shaft;

is bent to extend in a first direction and then bent to extend back in a second direction so as to form a receptacle; and is thereafter bent to extend parallel to the first axis but offset therefrom so as to form the actuator.

11. The jig of claim 10 in which the first and second directions are opposite directions.

* * * * *